US005133800A

United States Patent [19]

Ackermann et al.

[11] Patent Number: 5,133,800

[45] Date of Patent: Jul. 28, 1992

[54] FABRICATION OF CRYOGENIC REFRIGERATOR REGENERATOR MATERIALS BY SPARK EROSION

[75] Inventors: Robert A. Ackermann, Schenectady; John L. Walter, Ballston Lake, both of N.Y.

[73] Assignee: General Electric Company, Schenectady, N.Y.

[21] Appl. No.: 666,961

[22] Filed: Mar. 11, 1991

[51] Int. Cl.[5] ..... B22F 9/14

[52] U.S. Cl. ..... 75/335; 75/346; 264/25

[58] Field of Search ..... 75/245, 246, 335, 346, 75/10.19; 264/25, 27

[56] References Cited

U.S. PATENT DOCUMENTS

| | | | |
|---|---|---|---|
| 3,355,279 | 11/1967 | Ishibashi | 75/345 |
| 4,759,905 | 7/1988 | Walter et al. | 419/23 |
| 4,849,017 | 7/1989 | Sahashi et al. | 75/245 |
| 4,985,072 | 1/1991 | Sahashi et al. | 75/246 |

OTHER PUBLICATIONS

Walter, J. L., "On the Preparation of Powder by Spark Erosion", Technical Information Series, #88 CRD 202, Jul. 1988.

*Primary Examiner*—George Wyszomerski

*Attorney, Agent, or Firm*—James R. McDaniel; James C. Davis, Jr.; Paul R. Webb, II

[57] ABSTRACT

Materials for cryogenic refrigerator regenerators are formed by a high yield spark erosion cell. The materials are made of erbium or dysprosium and are spherical shaped. The spheres have a diameter range of 150 μm to 400 μm with a packing factor of at least 50%. The materials are made by disposing chunks of a starting material into a liquid dielectric in a spark chamber, agitating the chunks, impressing a spark voltage in order to cause melting of the chunks and formation of spherical particles, and collecting the particles at the bottom of the spark chamber. The particles may then be gathered, dried, and separated.

5 Claims, 2 Drawing Sheets

FABRICATION OF CRYOGENIC REFRIGERATOR REGENERATOR MATERIALS BY SPARK EROSION

BACKGROUND OF THE INVENTION

This invention relates to spark erosion systems of the type that produce spheres of intermetallic compounds containing rare earth materials, preferably, erbium or dysprosium. Such structures of this type, as described more completely in the following section entitled "Description of the Invention", generally produce a high yield of intermetallic spheres, preferably, in the size range of 150 μm to 400 μm. In particular with respect to the present invention, charges or chunks of alloys of erbium or dysprosium are placed in a high yield spark erosion cell which is located on a shaker table such that when a pulsed voltage is placed upon the electrodes of the spark erosion cell, intermetallic spheres are produced. This invention relates to certain unique intermetallic spheres and the manufacturing means in association therewith.

Prior to the present invention, as set forth in general terms above and more specifically below, it was known, in the manufacturing of cryogenic refrigerator regenerator materials to make use of an atomizing system with the hope of creating regenerator materials that would provide adequate specific heat and density properties. However, due to the inherent nature of the atomizing process, the material was, typically, too small in diameter and created a packing factor with too much density. The preferred diameter for application in a cryogenic refrigerator regenerator is 6–16 mils and the preferred packing factor or amount of volume taken up by the material itself, is 50%. Finally, the atomizing process was not cost efficient because the process requires at least ten pounds of charge material in order to operate efficiently and the amount of material, typically, used in a cryogenic refrigerator regenerator is less than ten pounds. Consequently, a more advantageous system, then, would be presented if such amounts of particle diameter and packing factor could be increased while reducing the amount of waste.

In order to at least attemt to reduce the amount of waste, techniques such as crushing and grinding of the regenerator material were employed. Simply, the material was placed in a container and crushed and ground by conventional techniques. The material was then sifted to separate the particles of different sizes. While this technique reduced the amount of waste because only the amount that was to be used in the regenerator was crushed, ground and sifted, the technique still produced acicular fine particles that had an undesirable packing factor. The particles were acicular mainly because the material used was very brittle which was conducive to creating these acicular particles. Therefore, further increase of the particle diameter and packing factor would be advantageous.

It is apparent from the above that there exists a need in the art for a system which produces cryogenic refrigerator regenerator materials, and which is not wasteful, but which at the same time produces materials which transfer heat efficiently. It is a purpose of this invention to fulfill this and other needs in the art in a manner more apparent to the skilled artisan once given the following disclosure.

SUMMARY OF THE INVENTION

Generally speaking, this invention fulfills these needs by providing a method of forming a cryogenic refrigerator regenerator material which comprises the steps of disposing chunks of erbium-nickel alloy as a body into a liquid dielectric in a spark chamber, agitating said body of chunks to cause momentary separation therebetween, impressing a spark voltage on and through said body to cause momentary melting at the surface of said chunks and formation of rapidly solidified particles of erbium-nickel composition therefrom, allowing said solidified particles to collect near the bottom of the spark chamber, gathering said solidified particles, drying said solidified particles, and separating said solidified particles.

In certain preferred embodiments, the particles are spherical and have a diameter range of 150 μm to 400 μm. Also, the particles have a packing factor of about 50%.

In another further preferred embodiment, the particles produced are heat transfer efficient and are produced such that the amount of wasted material is relatively low.

In particularly preferred embodiments, the method of this system consists essentially of a high yield spark erosion cell having a pulsed power source electrically connected to spaced electrodes such that chunks of erbium or dysprosium alloy are placed between the electrodes and the cell is agitated while the power source is activated to create a spark between the electrodes and the chunks of erbium or dysprosium alloy. The spark causes portions of the pieces to melt and rapidly solidify to form intermetallic spheres which settle to the bottom of the cell where they can be collected, dried, and separated.

The preferred method of forming cryogenic refrigerator regenerator materials, according to this invention, offers the following advantages: good stability; good durability; excellent efficiency; excellent product characteristics; and good safety characteristics. In fact, in many of the preferred embodiments, these factors of efficiency and product characteristics are optimized to an extent considerably higher than heretofore achieved in prior, known methods for producing cryogenic refrigerator regenerator materials.

BRIEF DESCRIPTION OF THE DRAWINGS

The above and other features of the invention which will be more apparent as the description proceeds are best understood by considering the following detailed description in conjunction with the accompanying drawings wherein like numbers represent like parts through out the several views and in which.

DETAILED DESCRIPTION OF THE INVENTION

Figure 1:
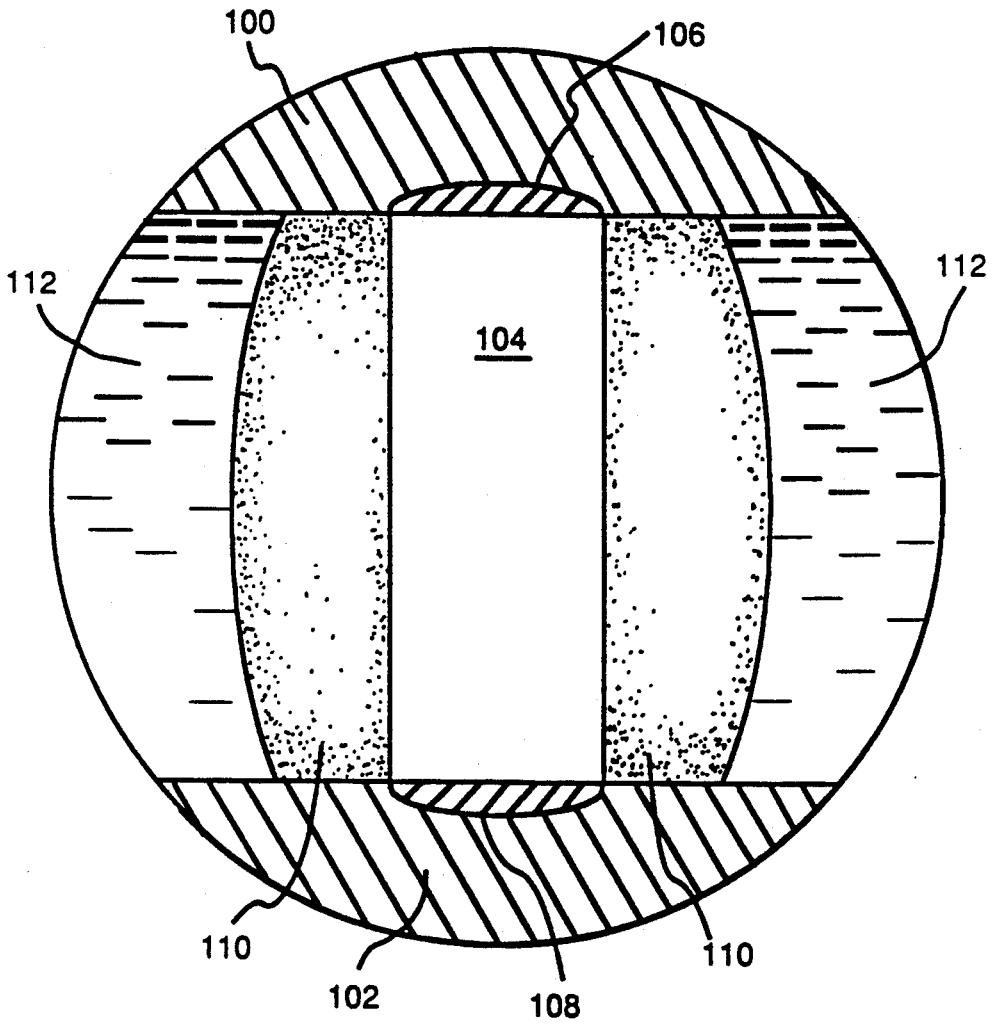
FIG. 1 is a schematic conceptual illustration of the type of phenomena which may occur as a spark or brief arc is established between two chunks of the raw material in the bath.

For the purposes of explanation and with reference to FIG. 1, the material 100 is an edge of a first chunk of such material and the body 102 is an edge of a second such chunk of material. The two chunks are separated by a body of dielectric 112 which before any current flows, extend uniformly through the region between the two confronting portions 100 and 102 of the respective first and second chunks. The gap between the respective chunk edges 100 and 102 is deemed to be relatively small and to be perhaps of the order of less than 50 microns. The gap is filled with the dielectrode liquid or gas 112 and the voltage applied to the first and second chunks permits a voltage of greater than 50 volts to be established across the gap. Under these conditions, the electric field E is equal to the voltage divided by the gap spacing. Also under these conditions, the electric field is high enough to enhance thermionic emission of electrons. These electrons are deemed to gain energy from the electric field and are deemed to be accelerated to ionize the dielectric liquid in the gap. As a result of the acceleration and ionization, more electrons and positive ions are produced in the gap. According to this mechanism, a plasma is formed in the gap very rapidly and in a time frame of less than 10 nanoseconds. Also, the plasma which is formed is deemed to have a temperature of greater than 10,000° Kelvin. The plasma is indicated in FIG. 1 as existing within the region 104 centrally located between the confronting portions 100 and 102 of the first and second chunks. The plasma in the region 104 is deemed to be surrounded by a vaporized dielectric illustrated as regions 110 above and below the plasma region 104. The vaporized dielectric region 110 is formed from vaporization of the dielectric 112 which has occupied all of the space between the chunks prior to formation of plasma.

From the description which is given, it will be recognized that there is formed, within a very short time frame, a very high temperature region within a closely confined volume and, as may be understood such high temperature in a confined volume will result in a increased pressure and an estimate is made that the pressure may be in the range of about 2–30 bars.

Figure 2:
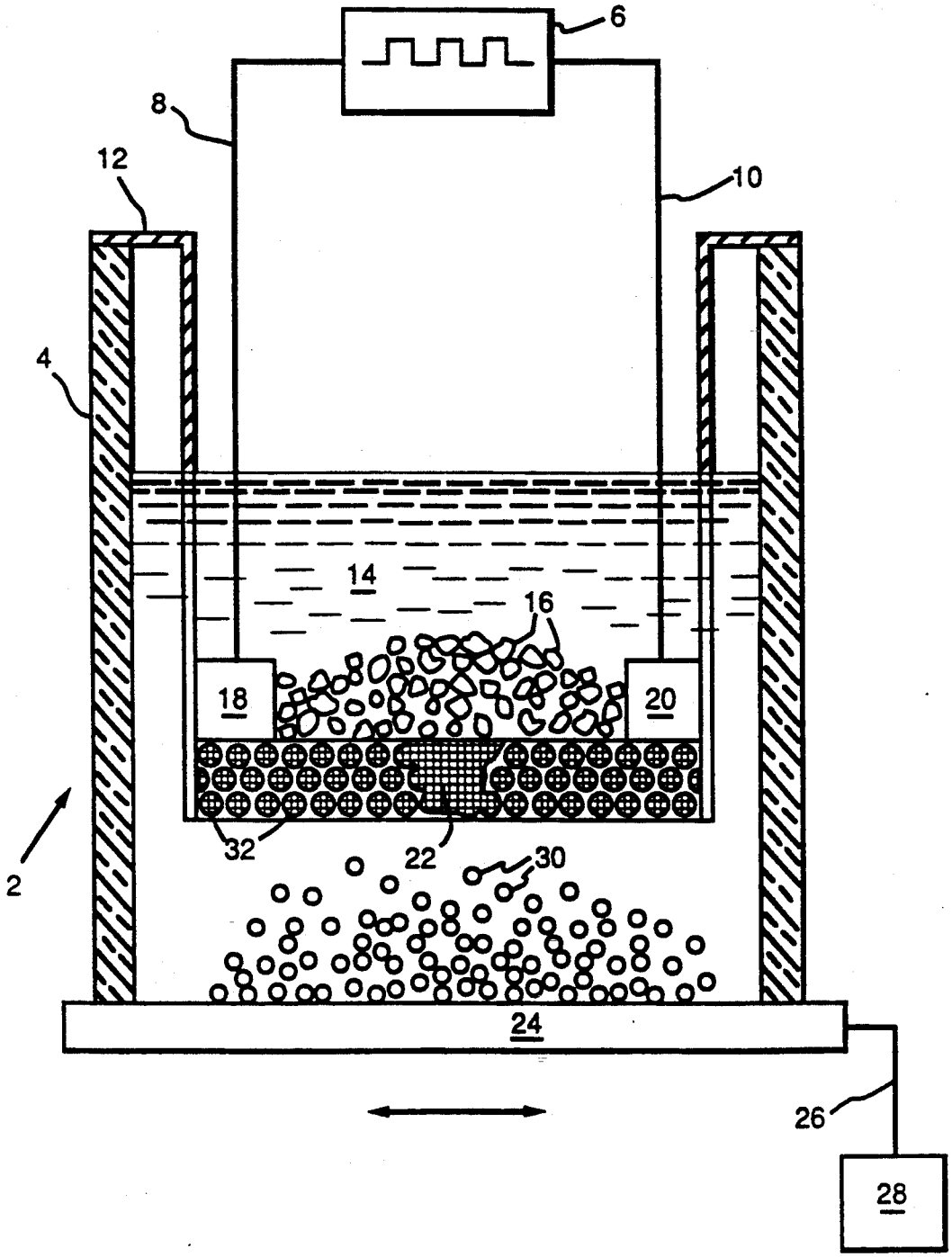
FIG. 2 is a schematic drawing of an apparatus for producing cryogenic refrigerator regenerator materials, according to the present invention.

With reference to FIG. 2, it will be understood that depending on how the electrodes 18 and 20 are connected to the power source either electrode 18 or 20 may be anode or cathode.

If we consider the case in which 18 is the anode and 20 is the cathode, it is evident that electrons go toward and to the anode 18 and positive ions go toward and to the cathode 20. The electrons move much more rapidly than the positive ions because the electrons are much lighter. For shorter pulses, the electrons are more effective in accomplishing spark erosion. For longer pulses, the ions are more effective. At higher voltages, the effective gaps between chunks can then be longer.

It will also be recognized that most of the heating of the charge of chunks of material will result from the transfer to the chunks of kinetic energy of the fast moving electrons or positive ions to a localized region of the confronting portions 100 and 102 of the adjacent first and second chunks. Such heating is extremely rapid and will occur at the confronting surfaces and is represented in FIG. 1 by the regions 106 and 108 showing molten material and by the material indicated as expelled as vapor or droplets into the plasma and with the passage of time into the vaporized dielectric and, in turn, into the dielectric itself.

As part of this explanatory description of suggested mechanism, it is presumed that the material in the regions 106 and 108 are raised to the boiling point of the material which is related to and associated with the high pressure within the plasma and its environment.

Also, the mechanism suggested here considers that while the plasma will be formed very rapidly, and in the order of less than 10 nanoseconds, that as the electric charge to the first and second chunks is dispelled that the spark between the confronting portions 100 and 102 will collapse. Further, the mechanism suggests that as the plasma forms and as it is maintained by the flow of current, although these periods are extremely short, the pressure will be quite high and although melting will occur at the chunk surface, no ejection of material will take place. This collapse of plasma may be due, for example, to the discharge of a capacitor furnishing its charge to the first and second chunks, and the capacitor will just discharge to a point at which the voltage is lower than that required to maintain the plasma. However, on a localized basis, after the plasma collapses, the superheated regions 106 and 108 of the material will violently boil and cause an expulsion of vaporized and/or molten materials portions of the material as vapor or droplets which will then be rapidly cooled in turn by the dielectric 112 in the region between the confronting portions 100 and 102 of the first and second chunks which had been occupied by the plasma and vaporized dielectric. The vapor and droplets are thus moved very rapidly into and through the vaporized sheath and liquid dielectric and are therefore cooled very rapidly.

It will also be appreciated that if the duration of the spark is very short, that this brevity of the spark and plasma formation and collapse will reduce the amount of heat which diffuses away from the portion of the chunk which is in contact with the plasma. Because of this very short duration, the energy which is developed and expended in plasma formation and chunk melting and vaporization is confined to a small region at the surface of a chunk as illustrated, for example, by the regions 106 and 108 of the confronting portions 100 and 102 of chunks as illustrated in FIG. 1. Because the energy is confined to such a small region, this promotes very high heating in a small volume and accordingly favors the vaporization of the materail over the formation of molten droplets. As the vaporized material is condensed by contact with the dielectric, smaller particles are formed. It is our conclusion and finding that in carrying out the process of the present invention the application of short pulses and the use of smaller capacitors with shorter time constants favors the formation of smaller particles.

Having now described a proposed mechanism for the action which occurs in carrying out the process of the present invention, description will be given now of a mechanism which has been found suitable for carrying out the process of the present invention and for the formation of fine particles of erbium or dysprosium.

With respect to FIG. 2, high yield spark erosion cell 2 includes container 4, which is, preferably, constructed of any suitable transparent material, such as, glass. Inner container 12, which is, preferably, constructed of Teflon® is placed so that its top or open end rests upon the top or open end of container 4. Holes 32 are located in the bottom end of container 12 and are formed by conventional techniques. Screen 22 is located inside of and near the bottom of container 12 so that screen 22 covers holes 32. Screen 22, preferably, is constructed of any suitable plastic which is capable of withstanding the processing. It is to be understood that the mesh size of screen 22 can vary according to the size of chunks 16 with the determining factor being that the mesh size should be small enough to keep chunks 16 from falling to the bottom of container 4 but large enough to allow spheres 30 to fall to the bottom of container 4.

A conventional power source 6 is connected by conventional connectors to leads 8,10 which are conventionally connected to electrodes 18 and 20, respectively. Power source 6 should be of such a type that it can deliver 100–500 volts at around one amp. Also, it is preferred that electrodes 18,20 be constructed of material that is the same as or substantially similar to chunks 16.

Container 4 is attached by conventional fasteners to a conventional shaker table 24. Table 24 is rigidly attached to arm 26 which is attached to a rotating eccentric (not shown) on a conventional shaker motor 28. Table 24 agitates chunks 16 so that when a spark is generated across electrodes 18,20, the movement of table 24 should not allow chunks to touch.

Located on the bottom of container 4 are intermetallic spheres 30. Spheres 30, as discussed earlier, are formed by melting, freezing and falling of portions of chunks 16. Dielectric fluid 14 is located within container 4. Fluid 14, preferably, is ethynol. Also, chunks 16 are located at the bottom of container 12. Chunks 16, preferably, are made of erbium or dysprosium.

In operation, container 4 is filled to a sufficient level with dielectric fluid 14. Container 12, having chunks 16 retained in the bottom by screen 22 is lowered into container 4 and held in place on container 4 by its own weight plus the weight of chunks 16. Container 12 also has leads 8,10 connected before it is lowered. Leads 8,10 are connected to power source 6.

After power source 6 is connected, shaker table 24 is turned on and power source 6 is turned on. The spark rate of power source 6 is measured by conventional operation panel (not shown). The operation of power source 6 and shaker table 24 cause spheres 30 to form my techniques described earlier. It is to be understood as the spark rate changes, the rate of agitation by the shaker table 24 can be changed. For example, if the spark rate decreases, the shake rate should be increased in order to maintain a uniform production rate of spheres 30. Also, as the amount of chunks 16 decreases, due to formation of spheres 30, more chunks can be added. The process of adding chunks 16 lends itself quite easily to automation.

After a predetermined amount of spheres 30 have been fabricated, power source 6 and motor 28 are shut down. Container 12 is removed and dielectric 14 is decanted by conventional techniques from container 4. Spheres 30 are then dried by conventional techniques, for example, evaporation, to remove any excess dielectric fluid 14. Finally, spheres 30 are separated by conventional separation techniques, for example, sifting through screens of predetermined mesh sizes.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. A method of forming a cryogenic refrigerator regenerator material which comprises the steps of:

disposing chunks of erbium-nickel as a body into a liquid dielectric in a spark chamber;

agitating said body of chunks to cause momentary separation therebetween;

impressing a spark voltage on and through said body to cause momentary melting at the surface of said chunks and formation of rapidly solidified particles of erbium-nickel composition therefrom wherein said solidified particles are comprised of spheres having a diameter range of 150 μm to 400 μm;

allowing said solidified particles to collect near the bottom of said spark chamber;

gathering said solidified particles;

drying said solidified particles; and separating said solidified particles.

2. The method of forming a cryogenic refrigerator regenerator material, according to claim 1, wherein said chunks are further comprised of:

dysprosium.

3. The method of forming a cryogenic refrigerator regenerator material, according to claim 1, wherein said solidified particles are further comprised of:

dysprosium nickel.

4. The method of forming a cryogenic refrigerator regenerator material, according to claim 1, wherein said solidified particles have a packing factor of about 50%.

5. The method of forming a cryogenic refrigerator regenerator material, according to claim 1, wherein said liquid dielectric is comprised of ethynol.

* * * * *